US006056334A

United States Patent [19]

Petzold et al.

[11] Patent Number: 6,056,334

[45] Date of Patent: May 2, 2000

[54] CLOSING DEVICE, IN PARTICULAR FOR VEHICLE DOORS OR THE LIKE

[75] Inventors: Sven Petzold, Wiesbaden; Klaus Rathmann, Frankfurt; Theo Baukholt, Kriftel; Jens Lübben, Schwalbach, all of Germany

[73] Assignee: Mannesmann VDO AG, Frankfurt, Germany

[21] Appl. No.: 08/921,207

[22] Filed: Aug. 27, 1997

[30] Foreign Application Priority Data

Sep. 7, 1996 [DE] Germany ..... 196 36 464

[51] Int. Cl.[7] ..... E05C 3/06

[52] U.S. Cl. ..... 292/216; 292/201; 292/DIG. 23

[58] Field of Search ..... 292/216, 201, 292/199, 336.3, DIG. 23; 70/262–264, 256, 257, 259, 277–279

[56] References Cited

U.S. PATENT DOCUMENTS

| | | | |
|---|---|---|---|
| 3,190,682 | 6/1965 | Fox et al. | 292/216 |
| 4,452,058 | 6/1984 | Noel | 292/201 |
| 4,518,180 | 5/1985 | Kleefeldt et al. | 292/201 |
| 4,518,181 | 5/1985 | Yamada | 292/201 |
| 4,763,936 | 8/1988 | Rogakos et al. | 292/201 |
| 4,904,006 | 2/1990 | Hayakawa et al. | 292/201 |
| 4,934,746 | 6/1990 | Yamada | 292/201 |
| 4,948,183 | 8/1990 | Yamada | 292/201 |
| 4,986,579 | 1/1991 | Ishikawa | 292/201 |
| 5,172,947 | 12/1992 | Schap | 292/201 |
| 5,180,198 | 1/1993 | Nakamura et al. | 292/201 |
| 5,236,234 | 8/1993 | Norman | 292/201 |
| 5,765,884 | 6/1998 | Armbruster | 292/216 |

FOREIGN PATENT DOCUMENTS

| | | |
|---|---|---|
| 0300840 | 1/1989 | European Pat. Off. . |
| 0430732 | 6/1991 | European Pat. Off. . |
| 0589158 | 3/1994 | European Pat. Off. . |
| 0645511 | 3/1995 | European Pat. Off. . |
| 4421879 | 1/1996 | European Pat. Off. . |
| 9012785 | 3/1991 | Germany . |
| 4436617 | 5/1996 | Germany . |

*Primary Examiner*—Teri Pham
*Attorney, Agent, or Firm*—Martin A. Farber

[57] ABSTRACT

A closing device, in particular for vehicle doors or the like, having at least one manipulator which, with the interpositioning of a coupling device via connecting elements to a lock element can be driven by a setting drive, in particular a pawl when the setting device is activated, a transmission of force can take place from the at least one manipulator to the lock element over the coupling device which has a setting device.

8 Claims, 2 Drawing Sheets

CLOSING DEVICE, IN PARTICULAR FOR VEHICLE DOORS OR THE LIKE

Figure 1:
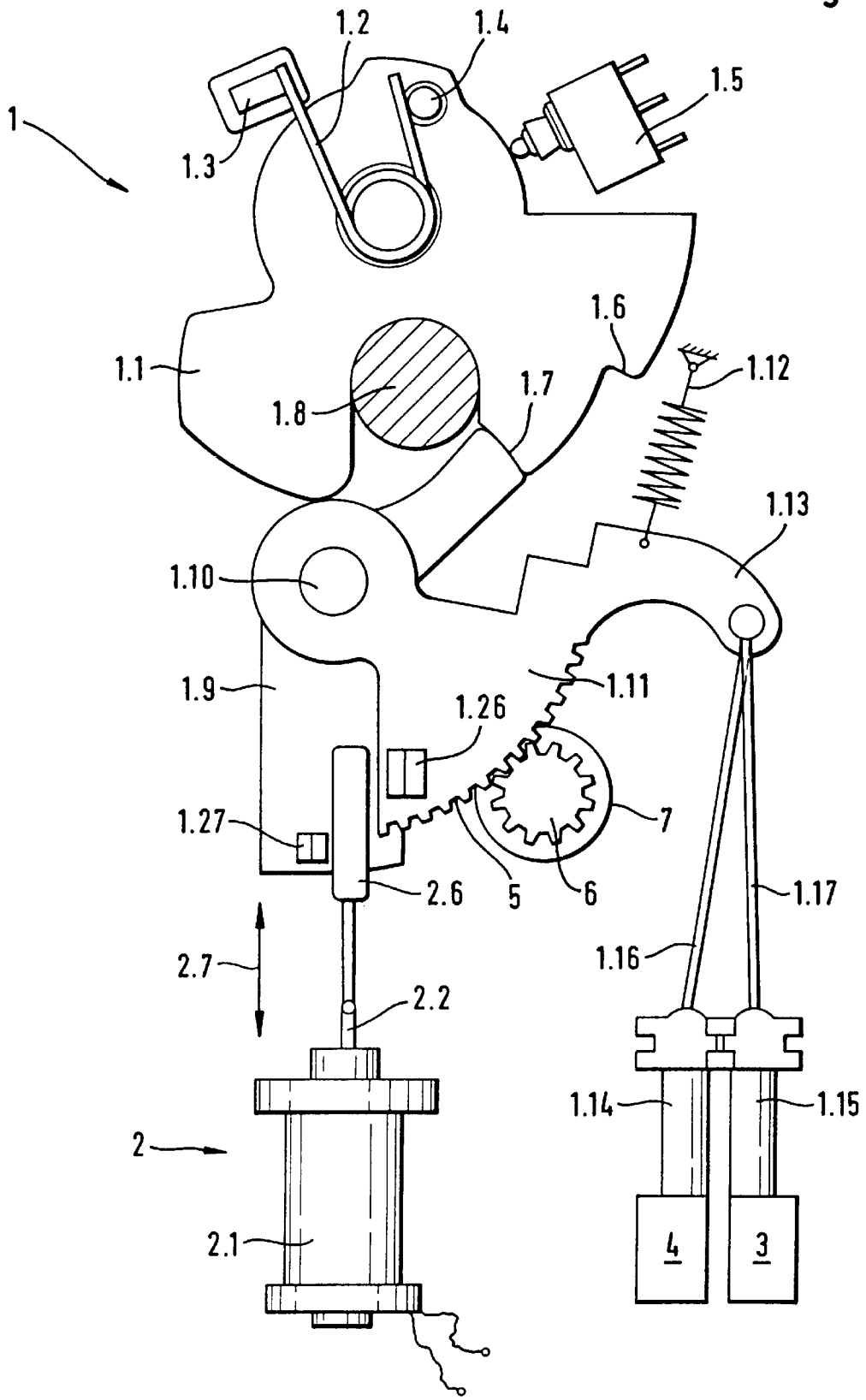

The present invention relates to a closing device, in particular, for vehicle doors or the like.

Such a closing device is known from EP 0 589 158 A1. In that closing device, if the actuation of a manipulator has been noted by a switch and the switch has been placed in active position by a control device, then a setting drive, which is developed as an electromagnet with ram, acts on the pawl, which then releases a rotary latch so that the door opens. This system operates satisfactorily and increases convenience but it has the serious disadvantage that, in case of failure of the current supply (for instance by a bad battery or as a result of an accident), the door cannot be opened by a door inside handle or a door outside handle or in any other manner.

In order to circumvent this problem, EP 0 589 158 A1 proposes a swing lever which is inactive when the setting drive is activated, i.e. it interrupts the force transmission path via connecting elements between the manipulators and the pawl. In this way, there is still the serious disadvantage that, for instance, when the current supply for the setting drive fails in the activated state of the setting drive and the setting drive does not return to its starting position, the opening of the door via the mechanical connection between the manipulator and the pawl is not possible. In this way, the operation of the closing device is impaired and this may lead, particularly in the case of accidents, to life-threatening situations for the occupants of the vehicle.

The further possibility described in EP 0 589 158 A1 of moving the setting drive in the case of an emergency is not satisfactory, since the ram of the setting drive is not in a defined position in all cases, so that in this way the pawl could be actuated mechanically from the manipulator. Furthermore the structural expense in this case is substantial.

SUMMARY OF THE INVENTION

The object of the present invention is, therefore, so to improve a closing device of the type already described that, on the one hand, convenience is retained in the form of the electromechanical opening of the door while at the same time assurance is had that in the event of failure of the setting drive the door can be reliably opened.

This object is achieved by the features.

First of all, it is provided that the coupling device has a setting device, in which connection the coupling device, controlled by a control device, opens or closes the force-transmission path between a manipulator and the pawl as ordered by the operator. Since now, in accordance with the invention, when the setting drive is activated for the moving of the pawl and thus for the convenient opening of the door, a transmission of force from the at least one manipulator to the lock element (the pawl) can be carried out via the coupling device. This has the advantage that, even upon a suddenly occurring defect of the setting drive, particularly upon a failure of the current supply, other defects being also conceivable, the door can be dependably opened by the at least one manipulator.

As a further development of the invention, the setting drive is developed as an electric motor with a reduction gearing acting on the pawl. Since the pawl generally carries out a rotary movement, the use of an electric motor is advantageous since it also carries out a rotating movement. If a step-down gearing is used, this entire setting drive can be of compact construction and at the same time build up the high forces for the actuating of the pawl. The pawl advantageously has on one face, within a swing region, a gear segment which is acted on by a pinion arranged on the shaft of the electric motor, possibly with the interpositioning of other step-down gears.

As a further development of the invention, at least the setting drive, the lock element, and the coupling device (including the setting device) are arranged in a housing. This has the advantage that the entire closing device can be preassembled and then installed in the door or the like, so that only the mechanical and electrical connections need then be provided.

As an alternative development for the drive of the pawl, it is possible for the setting drive to act on a connecting element between the lock element and the coupling device, or on a connecting element between the manipulator and the coupling device. As connecting elements there enter into consideration, for instance, Bowden cables, rods, or the like, in which case the setting drive then acts in such a manner on the connecting element that the pawl is moved by a release force of the setting drive and releases the rotary latch.

Figure 2:
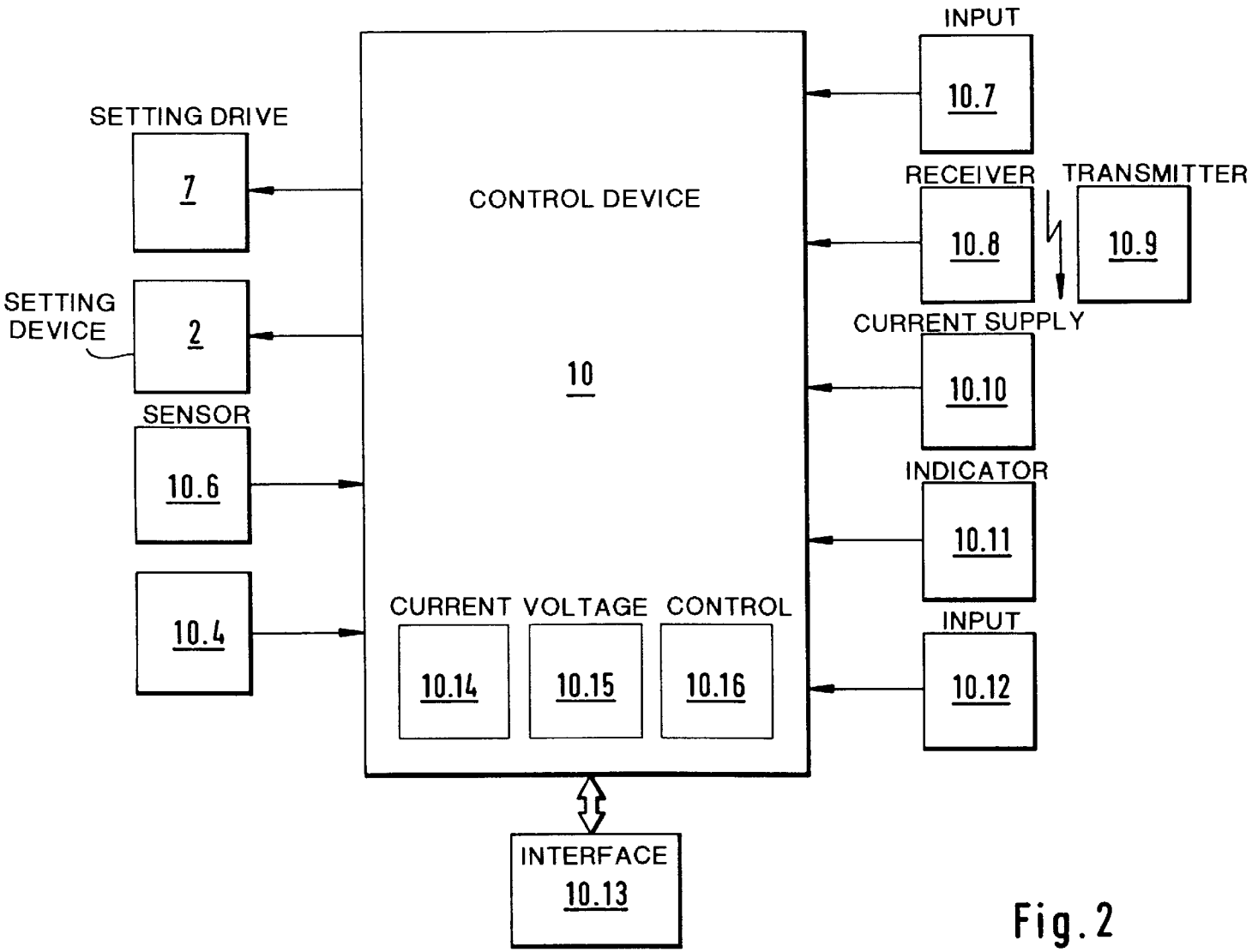

The invention permits of a large number of embodiments, particularly with regard to the setting drive and to the coupling device. One particularly advantageous embodiment, to which the invention, however, is not limited, is described below and shown in the figures of the drawing, in which: FIG. 1 shows a closing device in accordance with the invention; FIG. 2 shows a control device.

A closing device 1 shown in FIG. 1 has a rotary latch 1.1 which acts against a rotary-latch spring 1.2, the rotary-latch spring 1.2 being fastened between a stationary stop 1.3 and a stop 1.4 which is arranged on the rotary latch 1.1. The position of the rotary latch 1.1 can be detected by means of a rotary-latch switch 1.5. Furthermore, the rotary latch 1.1 has a shoulder 1.6 with which an intermediate detent position (preliminary detent) is produced. There is also a resting surface 1.7 by which the rotary latch 1.1 can be held in its locked position. The two arms of the U-shaped rotary latch 1.1 surround a closure wedge 1.8 and thus, for instance in known manner hold a car door in its closed position. {A projection (not specifically designated) in FIG. 1 of a pawl 1.9 which is swingable around a pivot point 1.10 rests against the resting surface 1.7 of the rotary latch 1.1. There is also supported around the pivot point 1.10 or another pivot point, a coupling element 1.11 of a coupling device, the coupling element being held by a spring 1.12 in the position shown in FIG. 1 (possible resting against a stop, not shown). {Means which make it possible to turn the coupling element 1.11 from the position shown in the drawing around the pivot point 1.10 act on a projection 1.13 of the coupling element 1.11. These means are connected with a door inside handle 3 and/or door outside handle 4 or other manipulators by which the coupling element 1.11 can be mechanically actuated. In FIG. 1 it is shown that these means are Bowden cables 1.14 and 1.15, each having a core 1.16, 1.17 which, in their turn, are prestressed by springs. By the actuating of a manipulator, the pawl 1.9 can be brought from the locking position shown into an opening position, so that the rotary latch 1.1 releases the locking wedge 1.8. The actuating of the door inside handle 3 can also be effected independently of movement of the door outside handle 4 and vice versa. The actuation can be detected by a switch.

The coupling device has a setting device 2 which may, for instance, be an electromagnet 2.1, having a linearly displaceable setting member 2.2 which can, but need not, act against a spring. The displacement of the setting member 2.2 effects a substantially linear displacement of a coupling member 2.6 into a direction of movement 2.7. It is also conceivable that the setting device act, stepped down or stepped up, on the coupling member 2.6, in which connection linear or rotary movements are then again also conceivable. It is shown in FIG. 1 that the coupling member 2.6 has substantially an elongated rectangular shape, other embodiments adapted to the constructions (such as, for instance, the wedge shaped development) being also conceivable. It is furthermore possible for the coupling member 2.6 and/or the components (for instance the setting device 2) actuating the coupling member 2.6 to be arranged on the pawl 1.9 or the coupling element 1.11.

The coupling element 1.11 has a stop 1.26 and the pawl 1.9 has a stop 1.27, which stops are staggered with respect to each other, in which case the coupling member 2.6 may be between the two stops 1.26 and 1.27 or, after actuation of the setting drive, be displaceable out of this region of the stops, or vice versa. If the coupling member 2.6 is in the coupled position (shown in FIG. 1) then, upon actuation of the door inside handle 3 or door outside handle 4 the stop 1.26 can be pressed, by turning the coupling element 1.11, against the coupling member 2.6 and the latter against the stop 1.27 of the pawl 1.9 so that the pawl 1.9 is moved over this path out of its locking position into its opening position and thus releases the rotary latch 1.1. If the coupling member 2.6 is moved by corresponding control of the setting device 2 out of the region of the stops (in particular out of the region of the stop 1.26), the coupling element 1.11, upon actuation of the door inside handle 3 or door outside handle 4, can be swung around the pivot point 1.10, but the pawl 1.9 cannot be carried along, so that the rotary latch 1.1 and thus the closure wedge 1.8 cannot be released. Thereby an anti-theft position and furthermore a child-proof door catch position as well as the preventing of undesired opening from the outside are achieved.

In addition to the coupling device, it is furthermore shown in FIG. 1 that an opening auxiliary drive is provided which drives the coupling element 1.11 or else the pawl 1.9 so that a comfortable opening of the door is assured. In the development shown in FIG. 1, the coupling element 1.11 (or the pawl 1.9) has, on one face within a range of swing, a gear segment 5 into which a gear wheel 6 engages, this gear wheel 6 being seated on the shaft of an electric motor of a setting drive 7. The embodiment arranged on the coupling element 1.11 in FIG. 1 can, in analogous manner, also be provided on the pawl 1.9. The gear segment 5 and the gear wheel 6 constitute a step-down gearing, in which connection, a stepping up or a direct drive is also conceivable. Further gears or the like can possibly also be interposed in order to obtain the step-up or step-down transmission. A worm drive is, in particular, also possible here.

With regard to the position of the coupling member 2.6 in the anti-theft position or in an unlocked position, there are several possibilities. One is that the coupling member 2.6 is present basically (for instance, when the setting device 2 is not actuated) outside the region of the stops 1.26 and 1.27 (anti-theft position). If the manipulator is actuated for opening in accordance with the desire of the operator which is legitimated, for instance, by the transmitter 10.9 (FIG. 2), and a corresponding send command has been given, the setting device 2 is actuated and the coupling member 2.6 moved into the region of the stops 1.26 and 1.27 before one of the connecting elements has moved over a substantial distance.

In addition to this, it is possible in the unactuated condition of the setting device 2 to leave the coupling member 2.6 between the stops 1.26 and 1.27 and to move it (by actuation of the setting device 2) out of this region only in the event that the anti-theft device or a child-proof door-catch device are engaged.

The conditions under which the setting device 2 is actuated, in particular with consideration of the signals of the switch or the like which detect the actuation of a manipulator, the movement of the connecting elements or the like, are actuated, described below on the example of a control device.

FIG. 2 shows a control device 10 by which the setting device is controlled as a function of open or close commands. For this, the control device 10 is connected to the setting device 2 (in particular, the electromagnet 2.1), the control device receiving information as to the actuation of at least one manipulator (door handle, push button or the like) via sensors (switches or the like) and/or information as to the position of the rotary latch 1.1 via a sensor 10.6 (rotary-latch switch 1.5). Furthermore, an input device 10.7 (for instance, a switch for the activating or deactivating of a child-proof door catch) is associated with the control device 10 as well as a receiving device 10.8, open or close commands being transmittable via a transmitter 10.9 to the receiving device 10.8. Furthermore, a current supply 10.10, an indicating device 10.11 (for indication of the status) as well as a further input device 10.12 can be associated with the control device 10. In addition, the control device 10 can be provided with an interface 10.13 via which given functions can be established over which further information as to the status of the vehicle can be transmitted to the control device 10. Preferably there can be integrated in the control device 10 an emergency current supply 10.14 and a voltage monitoring 10.15 which, for instance, activates the emergency current supply 10.14 when a predeterminable voltage threshold is dropped below. The two components 10.14 and 10.15 can be, but need not be, present. 10.16 is an input and output control as well as a control and memory logic with which, contained for instance in a program, the functions of the control device can be carried out.

The control device 10 operates as follows:

Let us assume, first of all, that the electromagnet 2.1 is without current and that the coupling member 2.6 has been moved out of the region of the stops 1.26/1.27 by the electromagnet 2.1 so that, while the door inside handle 3 or door outside handle 4 can be operated, the pawl 1.9 is not turned. This means that the doors of the car are closed and thus an anti-theft position is present. If the driver of the vehicle for instance desires that at least one door be opened or that the entire central locking system be actuated, he actuates the transmitter 10.9 or, for instance, also the further input device 10.12, the latter being so developed that it can be actuated only under certain conditions which are known, for instance, to the driver. This can, for instance, be the inputting of a numerical code. {After this input or actuation of the transmitter 10.9, the switch or switches on the manipulators are switched into the active position so that, after actuation of the door inside and/or outside handle, if the coupling member 2.6 is between the stops 1.26 and 1.27 (and therefore coupled), the setting drive 7 is actuated. Thus, for instance, the electric motor is connected, so as to turn the pawl 1.9 by electric motor (possibly, for instance, also electrohydraulically, pneumatically or the like) and the rotary latch 1.1 is released so that the door opens. Since the door opens directly, the operator will not continue to pull on the inside or outside door handle so that, while further actuating of the manipulator would also lead to the opening of the door. This, however, as a rule, does not take place, since the door has already been opened electromotively. If the release of the rotary latch 1.1, for instance the rotary-latch switch 1.5, has been detected, the control device 10 reverses the polarity of the electric motor so that the motor moves into its starting position and a new opening process can be effected. In the event that the current supply fails during the course of the opening or has failed prior to it, the setting drive 7 can be overridden by manual actuation of the manipulator and the door opened in any event. {It is also possible for the setting device 2 to be actuated first of all, i.e. for the electromagnet 2.1 to be connected until the coupling member 2.6 is moved into the region of the stops 1.26/1.27 and for the setting drive 7 to then be actuated. In such case, the arrangement or the switch point of the switch or the connecting of the setting device 2 and the setting drive 7 should be so selected that the pulling on one of the cores 1.16/1.17 first of all actuates the switch, which brings about the coupling of the coupling member 2.6. Then after the coupling member 2.6 has been coupled, in the normal case the setting drive 7 is activated or, in the case of an emergency, the further pulling on one of the cores 1.16/1.17 effects the turning of the coupling element 1.11 and the carrying along of the pawl 1.9. Thereby the rotary latch is released from its locked position into its open position. For this purpose there is a certain idle path, for instance between the stop 1.26 and the coupling member, so that upon the pulling one of the cores 1.16/1.17, the switch is first actuated and then, only after a sufficient period of time to couple the coupling member 2.6 at least substantially free of play, is the coupling element 1.11 actuated. {When the rotary latch 1.1 has reached its open position, this is recognized by the sensor 10.6 (rotary-latch switch 1.5) and the setting device 2 remains in its position. After the release of the door inside or outside handle, the pawl 1.9 rests under spring load against the rotary latch 1.1 so that when the door is closed, the locking wedge 1.8 is forced into the rotary latch 1.1 and the spring-loaded pawl 1.9 holds the rotary latch 1.1 after a "snapping" in its locking position.

It is also possible for the coupling member 2.6 to be between the stops 1.26/1.27 and then, when an anti-theft position desired, is upon actuation of the door outside handle (and possibly also of the door inside handle) and thus of its switch, the setting device is in due time actuated so as to move the coupling member 2.6 out of the region between the stops 1.26/1.27. If the door is to be opened, the setting device 2 is not controlled, so that the mechanical functional connection can be brought about between the door inside or outside handle up to the pawl 1.9 (as already described). In the event that the coupling member 2.6 is coupled and the regular supply of current (for instance a car battery) has failed (for instance due to a defect, accident, or break of cable), the opening of the door by means of the manipulator is always assured via the connecting elements.

What is claimed is:

1. A closing device suitable for vehicle doors, comprising a coupling device, a lock element, a setting drive, and at least one manipulator;

wherein, with interpositioning of said coupling device to said lock element, said lock element is driven by said setting drive; said lock element comprises a pawl; and upon actuation of said setting drive, a transmission of force takes place from said at least one manipulator to said lock element via said coupling device, said coupling device having a setting device.

2. A closing device according to claim 1, wherein said setting drive acts on a connecting element between said lock element and said coupling device, or on a connecting element between said at least one manipulator and said coupling device.

3. A closing device according to claim 1, wherein said setting drive comprises an electric motors, a step-down gearing acting on said pawl, wherein said electric motor acts on said pawl via said step-down gearing.

4. A closing device according to claim 3, further comprising a housing, wherein at least the setting drive, said lock element, and said coupling device with its setting device are arranged in said housing.

5. A closing device according to claim 1, wherein said coupling device further comprises a coupling element, and wherein said setting drive comprises an electric motors, a step-down gearing acts on said coupling element, said coupling element being connected by connecting elements with said at least one manipulator.

6. A closing device according to claim 5, further comprising a plurality of manipulators including said at least one manipulator, and wherein said manipulators comprise a door inside handle and a door outside handle which are connected, via said connecting elements to said coupling element.

7. A closing device according to claim 1, wherein said lock element is drivable only when said setting drive is actuated, wherein said coupling device, via activation of said setting device thereby, is in a coupling position with the lock element in path of the force transmission.

8. A closing device according to claim 7, wherein said coupling device includes a coupling member movable by said setting device into said coupling position, and respectively, removable from said coupling position in dependency on actuation, and respectively deactuation of said setting drive.

* * * * *